US006586337B2

(12) United States Patent
Parikh

(10) Patent No.: US 6,586,337 B2
(45) Date of Patent: Jul. 1, 2003

(54) METHOD AND APPARATUS FOR ENDPOINT DETECTION DURING CHEMICAL MECHANICAL POLISHING

(75) Inventor: Prabodh J. Parikh, Tempe, AZ (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 0 days.

(21) Appl. No.: 10/035,519

(22) Filed: Nov. 9, 2001

(65) Prior Publication Data

US 2003/0092269 A1 May 15, 2003

(51) Int. Cl.[7] ..... H01L 21/302; H01L 21/461
(52) U.S. Cl. ..... 438/692; 438/746
(58) Field of Search ..... 438/692, 707, 438/710, 716, 726, 16, 693, 746

(56) References Cited

U.S. PATENT DOCUMENTS

| | | | | |
|---|---|---|---|---|
| 3,762,378 A | * | 10/1973 | Bitonti | |
| 4,357,104 A | * | 11/1982 | Davinson | |
| 5,036,015 A | | 7/1991 | Sandhu et al. | 438/14 |
| 5,081,796 A | | 1/1992 | Schultz | 51/165.74 |
| 5,240,552 A | | 8/1993 | Yu et al. | 156/636 |
| 5,337,015 A | | 8/1994 | Lustig et al. | 324/671 |
| 5,490,413 A | * | 2/1996 | Atkinson | |
| 5,605,488 A | | 2/1997 | Ohashi et al. | 451/7 |
| 5,605,760 A | | 2/1997 | Roberts | 428/409 |
| 5,916,016 A | | 6/1999 | Bothra | 451/308 |
| 6,058,769 A | * | 5/2000 | Corriveau et al. | |
| 6,146,242 A | * | 11/2000 | Treur et al. | |
| 6,158,276 A | * | 12/2000 | Patey et al. | |
| 6,280,290 B1 | * | 8/2001 | Birang et al. | |
| 6,454,630 B1 | | 9/2002 | Tolles | |
| 6,488,568 B1 | * | 12/2002 | Treur et al. | |

FOREIGN PATENT DOCUMENTS

EP 0 916 452 A2 5/1999

* cited by examiner

*Primary Examiner*—Phuc T. Dang
(74) *Attorney, Agent, or Firm*—Snell & Wilmer, L.L.P.

(57) ABSTRACT

An apparatus for in situ CMP endpoint detection is presented which includes a probe member for emitting and receiving light signals, a transparent plug mounted over the end of the probe, and a support member located about, and slidably engaged with, the outer circumference of the probe. In use, the plug is inserted into an opening in a polishing pad so that the top of the plug is recessed or coplanar with respect to the polishing surface of the pad and the support member is inserted into an opening in a platen such that a seal is formed between the platen and the support member. The probe member, plug, and/or support member may be disposable and replaceable either alone or in combination.

15 Claims, 10 Drawing Sheets

METHOD AND APPARATUS FOR ENDPOINT DETECTION DURING CHEMICAL MECHANICAL POLISHING

FIELD OF INVENTION

The present invention generally relates to polishing a surface of a workpiece. More particularly, the invention relates to improved methods and apparatus for in situ monitoring of a wafer during chemical mechanical polishing (CMP).

BACKGROUND OF THE INVENTION

Chemical mechanical polishing or planarizing a surface of an object may be desirable for several reasons. For example, chemical mechanical polishing is often used in the formation of microelectronic devices to provide a substantially smooth, planar surface suitable for subsequent fabrication processes such as photoresist coating and pattern definition. Chemical mechanical polishing may also be used to form microelectronic features. For example, a conductive feature such as a metal line or a conductive plug may be formed on a surface of a wafer by forming trenches and vias on the wafer surface, depositing conductive material over the wafer surface and into the trenches and vias, and removing the conductive material on the surface of the wafer using chemical mechanical polishing, leaving the vias and trenches filled with the conductive material.

A typical chemical mechanical polishing apparatus suitable for planarizing the semiconductor surface generally includes a wafer carrier configured to support, guide, and apply pressure to a wafer during the polishing process; a polishing compound such as a slurry containing abrasive particles and chemicals to assist removal of material from the surface of the wafer; and a polishing surface such as a polishing pad. In addition, the polishing apparatus may include an integrated wafer cleaning system and/or an automated load and unload station to facilitate automatic processing of the wafers.

A wafer surface is generally polished by moving the surface of the wafer to be polished relative to the polishing surface in the presence of the polishing compound. In particular, the wafer is placed in the carrier such that the surface to be polished is placed in contact with the polishing surface and the polishing surface and the wafer are moved relative to each other while slurry is supplied to the polishing surface.

In order to determine when the wafer has been polished to its desired degree of flatness, the front surface of the wafer must be monitored during the planarization process. Many end-point detection systems rely on the change of the surface structure of the wafer as an overlying layer is removed. For example, a change in friction between the wafer and the polishing pad indicates end-point in U.S. Pat. No. 5,036,015, the analysis of reflected acoustic waves measures wafer thickness in U.S. Pat. No. 5,240,552, and special electrodes under the polishing pad combined with an electrically grounded polishing table and use of a conducted slurry are used to measure dielectric thickness in U.S. Pat. No. 5,337,015.

Ex-situ methods are also used to determine end-point. For example, wafers may be removed from the polishing apparatus so that flatness can be measured using a spectroscopic device, which measures oxide film thickness, before being replaced in the polishing apparatus for polishing to the desired endpoint. This process requires that the wafer be removed from polishing before the expected endpoint so that overpolishing does not occur.

Still other endpoint detection methods, such as that described in U.S. Pat. No. 5,081,796, move the wafer over the edge of the polishing pad to rapidly measure the oxide layer using techniques such as laser interferometry. However, with this method, moving a portion of the wafer over the edge of the pad results in the wafer failing to receive uniform polishing at all times.

More recent end point detection methods carry out optical detection of a wafer surface condition during polishing by utilizing a polishing pad having a portion thereof, or window, constructed from an optically clear polymer. The clear polymer window has no ability to absorb or transport slurry particles and is also transparent to the light beam being used to detect the wafer surface condition by optical methods. The process for making an apparatus capable of carrying out this type of endpoint detection method generally includes 1) making one or more holes in the polish pad at the locations for utilizing endpoint detection probes, 2) casting an optically clear liquid or gel adhesive polymer in the holes in the pad, 3) curing and finishing the cast polymer, 4) installing the pad on the platen of a CMP tool with transparent windows in the pad aligned to probe locations, and 5) installation of probes under the windows.

However, shortcomings of this most recent endpoint technology include the long and somewhat costly process of producing the transparent windows in the pads as well as potential manufacturing issues which may need to be addressed in the event that stacked polishing pads are used for polishing. Moreover, if curing of the transparent windows in the pads occurs at a temperature higher than room temperature, the adhesive layer on the pad may exhibit possible adverse effects. Finally, both logistic and quality issues may arise when there are multiple pad manufacturers.

Accordingly, there is a need for an in situ endpoint detection method and apparatus which is accurate as well as reliable and less costly.

SUMMARY OF THE INVENTION

The present invention provides improved methods and apparatus for chemical mechanical polishing of a surface of a workpiece that overcome many of the shortcomings of the prior art. While the ways in which the present invention addresses the drawbacks of the now-known techniques for chemical mechanical polishing will be described in greater detail hereinbelow, in general, in accordance with various aspects of the present invention, the invention provides an apparatus for end-point detection which includes a probe having an end for emitting and receiving light and a transparent plug mounted over the probe which fits into an opening in a polishing pad so that a polishing endpoint can be detected while polishing a workpiece.

In accordance with an exemplary embodiment of the present invention, the endpoint detection apparatus also includes a support member located beneath the plug and about an outer circumference of the probe. In order to perform endpoint detection using a CMP platen and polishing pad with this exemplary embodiment, the probe is positioned so that the support member fits into an opening within the platen and the plug fits into an opening within the polishing pad. The top of the transparent plug is positioned coplanar with the top surface of the polishing pad while the support member forms a sealable fit within the platen so that slurry does not leak through the platen during polishing.

In one aspect of the endpoint detection system of the present invention, the support member is attached to the probe such that it is in slidable engagement with the probe along a length of the probe. Accordingly, when the probe is elevated to position the plug within the opening in the polishing pad, the support member can be pushed upward toward the plug so that the support member fits securely and snugly within the opening in the platen.

In yet another aspect of the present invention, the plug and/or probe and/or support member may be removable and replaceable. The plug is preferentially comprised of a transparent polymer material that can transmit light signals while the support member is preferably comprised of a conformable polymer that is chemically resistant to slurry.

In still another aspect of the invention, a rigid sleeve member may be contained within the plug for receiving the end of the probe.

It will be understood by those skilled in the art that the endpoint detection system of the present invention is capable of being utilized in any polishing system which employs a polishing pad secured to a platen for polishing.

In accordance with another embodiment of the invention, a method for detecting endpoint during CMP is presented which includes 1) selecting a probe having an end for emitting and receiving light, 2) mounting a transparent plug over the end of the probe, 3) inserting the plug through an opening in a polishing pad so that the top of the plug is recessed or coplanar with respect to the top of the polishing pad, 4) polishing a workpiece against the top surface of the polishing pad, and 5) transmitting and receiving an optical signal through the probe to determine an endpoint for polishing.

In accordance with another embodiment of the invention, the above described method may also include the step of positioning a support member into an opening in a platen used to retain the polishing pad so that the support member forms a seal with the opening in the platen.

BRIEF DESCRIPTION OF THE DRAWINGS

A more complete understanding of the present invention may be derived by referring to the detailed description and claims, considered in connection with the figures, wherein like reference numbers refer to similar elements throughout the figures, and:

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF EXEMPLARY EMBODIMENTS

The following description is of exemplary embodiments only and is not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
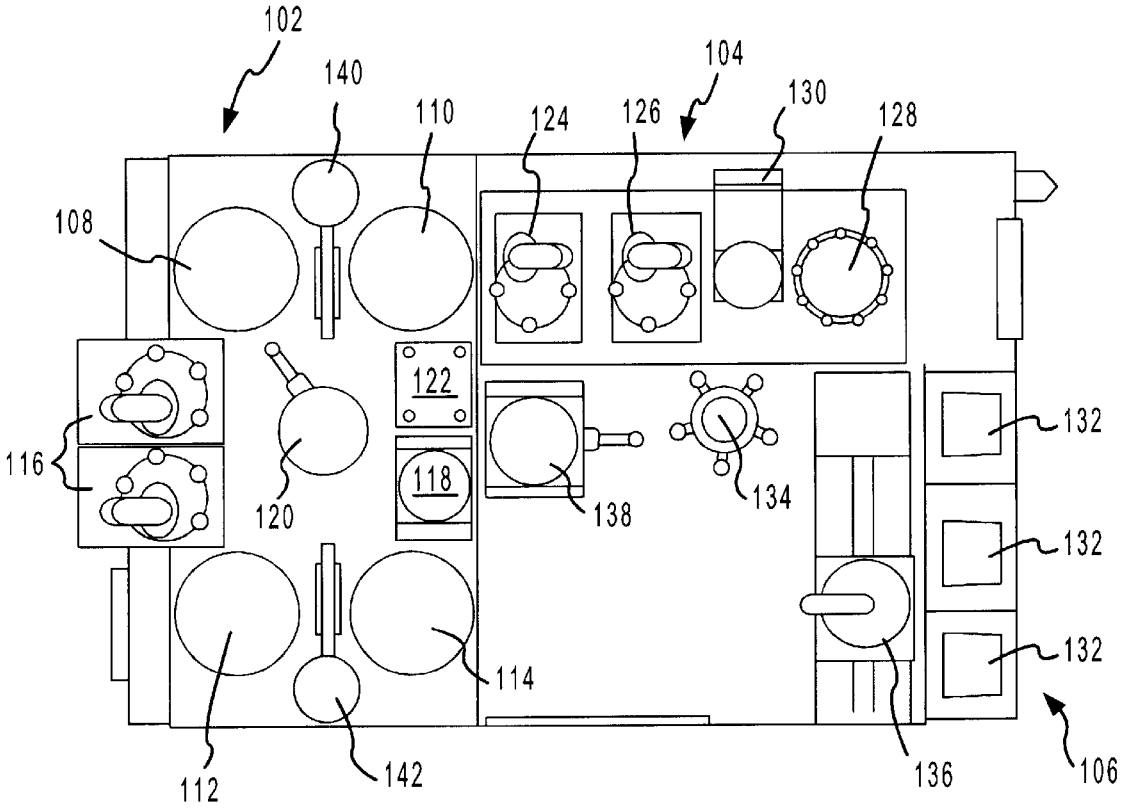
FIG. 1 illustrates a top cut-away view of a polishing system in accordance with the present invention.

FIG. 1 illustrates a top cut-way view of a polishing apparatus 100, suitable for removing material from a surface of a workpiece, in accordance with the present invention. Apparatus 100 includes a multi-platen polishing system 102, a clean system 104, and a wafer load and unload station 106. In addition, apparatus 100 includes a cover (not illustrated) that surrounds apparatus 100 to isolate apparatus 100 from the surrounding environment. In accordance with a preferred embodiment of the present invention machine 100 is a Momentum machine available from SpeedFam-IPEC Corporation of Chandler, Ariz. However, machine 100 may be any machine capable of removing material from a workpiece surface.

Although the present invention may be used to remove material from a surface of a variety of workpieces such as magnetic discs, optical discs, and the like, the invention is conveniently described below in connection with removing material from a surface of a wafer. In the context of the present invention, the term "wafer" shall mean semiconductor substrates, which may include layers of insulating, semiconducting, and conducting layers or features formed thereon, used to manufacture microelectronic devices.

Exemplary polishing system 102 includes four polishing stations 108, 110, 112, and 114, which each operate independently; a buff station 116; a transition stage 118; a robot 120; and optionally, a metrology station 122. Polishing stations 108–114 may be configured as desired to perform specific functions; however, in accordance with the present invention, at least one of stations 108–114 includes an orbital polishing station as described herein. The remaining polishing stations may be configured for chemical mechanical polishing, electrochemical polishing, electrochemical deposition, or the like.

Polishing system 102 also includes polishing surface conditioners 140, 142. The configuration of conditioners 140, 142 generally depends on the type of polishing surface to be conditioned. For example, when the polishing surface comprises a polyurethane polishing pad, conditioners 140, 142 suitably include a rigid substrate coated with diamond material. Various other surface conditioners may also be used in accordance with the present invention.

Clean system 104 is generally configured to remove debris such as slurry residue and material removed from the wafer surface during polishing. In accordance with the illustrated embodiment, system 104 includes clean stations 124 and 126, a spin rinse dryer 128, and a robot 130 configured to transport the wafer between clean stations 124, 126 and spin rinse dryer 128. In accordance with one aspect of this embodiment, each clean station 124 and 126 includes two concentric circular brushes, which contact the top and bottom surfaces of a wafer during a clean process.

Figure 2:
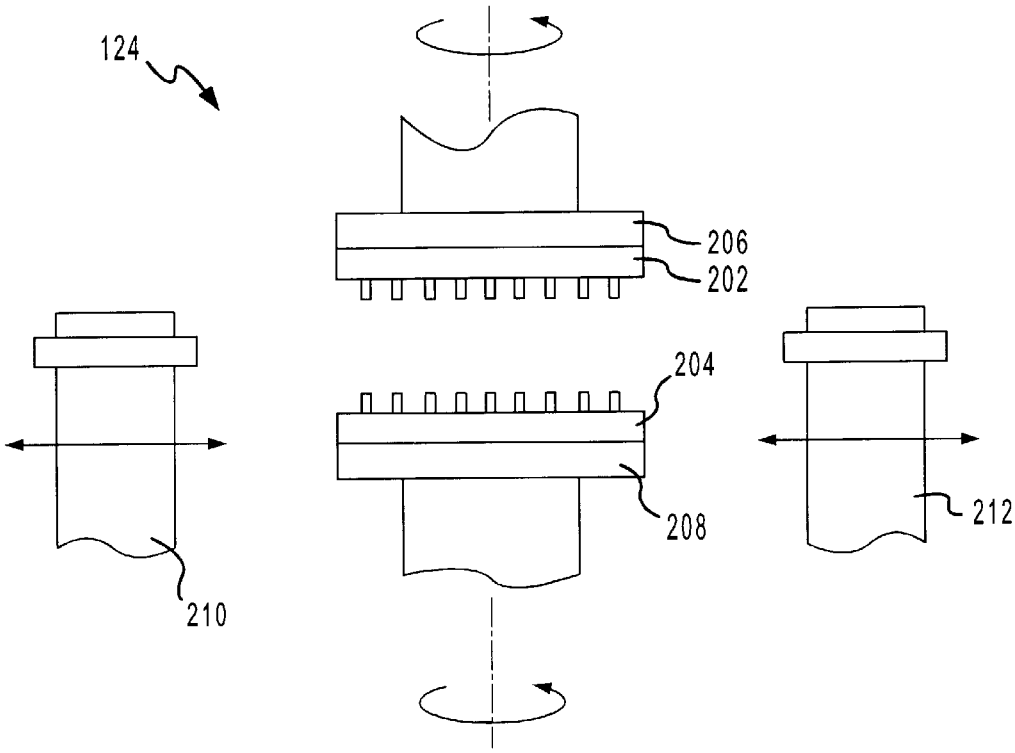
FIG. 2 illustrates a side view of a portion of a clean system for use with the apparatus of FIG. 1.

FIG. 2 illustrates an exemplary clean station (e.g., station 124) in greater detail. Clean station 124 includes brushes 202, 204 mounted to brush platens 206, 208. Station 124 also includes movable rollers—e.g., capstan rollers 210, 212—to keep the wafer in place during the clean process.

In accordance with one embodiment of the invention, during the clean operation, a wafer is placed onto the capstan rollers, and lower clean platen 208 and brush 204 rise to contact and apply pressure to a lower surface of the wafer, while upper platen 206 and brush 202 lower to contact the upper surface of the wafer The brushes are then caused to rotate about their axes to scour the surfaces of the wafer in the presence of a cleaning fluid such as deionized water and/or a $NH_4OH$ solution.

Referring back to FIG. 1, wafer load and unload station 106 is configured to receive dry wafers for processing in cassettes 132. In accordance with the present invention, the wafers are dry when loaded onto station 106 and are dry before return to station 106.

In accordance with an alternate embodiment of the invention, clean system 104 may be separate from the polishing apparatus. In this case, load station 106 is configured to receive dry wafers for processing, and the wafers are held in a wet (e.g., deionized water) environment until the wafers are transferred to the clean station.

In operation, cassettes 132, including one or more wafers, are loaded onto apparatus 100 at station 106. A wafer from one of cassettes 132 is transported to a stage 134 using a dry robot 136. A wet robot 138 retrieves the wafer at stage 134 and transports the wafer to metrology station 122 for film characterization or to stage 118 within polishing system 102. In this context, a "wet robot" means automation equipment configured to transport wafers that have been exposed to a liquid or that may have liquid remaining on the wafer and a "dry robot" means automation equipment configured to transport wafers that are substantially dry. Robot 120 picks up the wafer from metrology station 122 or stage 118 and transports the wafer to one of polishing stations 108–114 for chemical mechanical polishing.

After polishing, the wafer is transferred to buff station 116 to further polish the surface of the wafer. The wafer is then transferred (optionally to metrology station 122 and) to stage 118, which keeps the wafers in a wet environment, for pickup by robot 138. Once the wafer is removed from the polishing surface, conditioners 140,142 may be employed to condition the polishing surface. Conditioners 140, 142 may also be employed prior to polishing a wafer to prepare the surface for wafer polishing.

After a wafer is placed in stage 118, robot 138 picks up the wafer and transports the wafer to clean system 104. In particular, robot 138 transports the wafer to robot 130, which in turn places the wafer in one of clean stations 124, 126. The wafer is cleaned using one or more stations 124, 126 and is then transported to spin rinse dryer 128 to rinse and dry the wafer prior to transporting the wafer to load and unload station 106 using robot 136.

Figure 3:
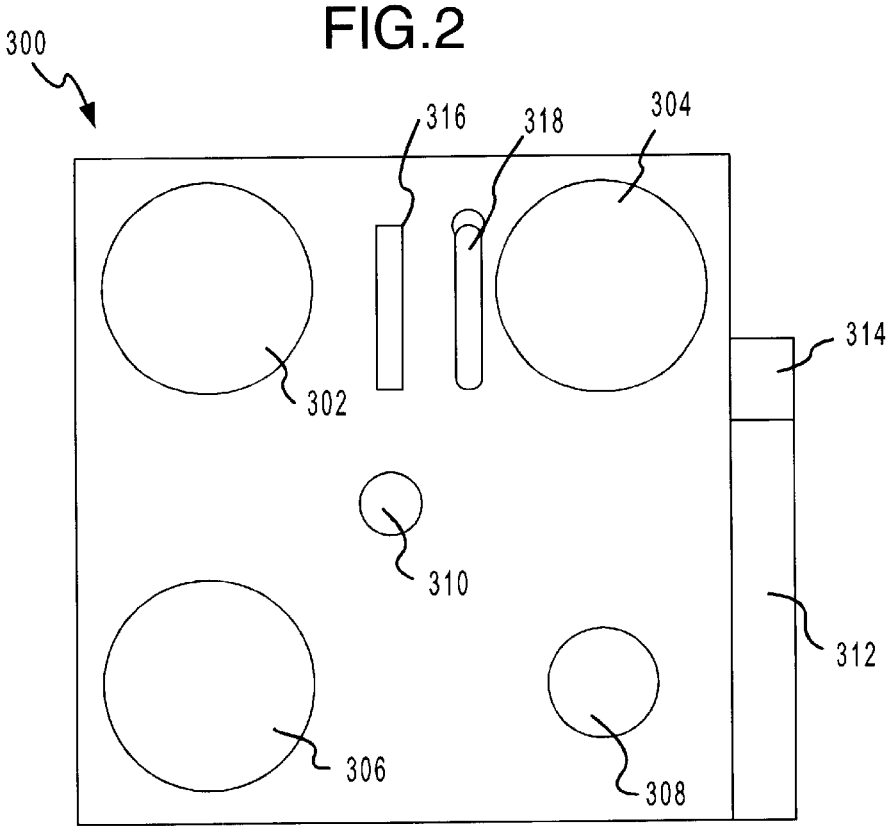
FIG. 3 illustrates a top cut-away view of a polishing system in accordance with another embodiment of the invention.
Figure 4:
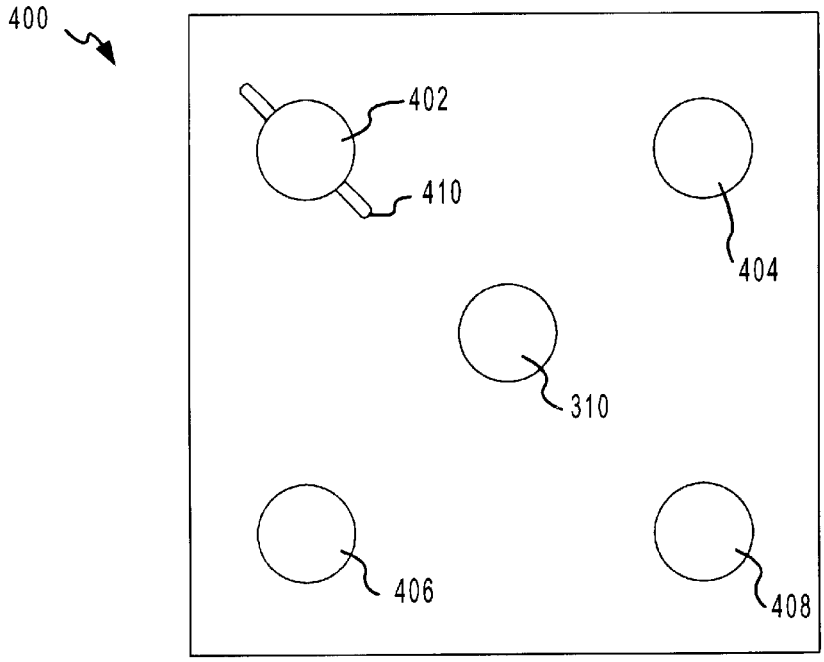
FIG. 4 illustrates a bottom view of a carrier carousel for use with the apparatus illustrated in FIG. 3.

FIG. 3 illustrates a top cut-away view of another exemplary polishing apparatus 300, configured to remove material from a wafer surface. Apparatus 300 is suitably coupled to carousel 400, illustrated in FIG. 4, to form an automated chemical mechanical polishing system. A chemical mechanical polishing system in accordance with this embodiment may also include a removable cover (not illustrated in the figures) overlying apparatus 300 and 400.

Apparatus 300 includes three polishing stations 302, 304, and 306, a wafer transfer station 308, a center rotational post 310, which is coupled to carousel 400, and which operatively engages carousel 400 to cause carousel 400 to rotate, a load and unload station 312, and a robot 314 configured to transport wafers between stations 312 and 308. Furthermore, apparatus 300 may include one or more rinse washing stations 316 to rinse and/or wash a surface of a wafer before or after a polishing process and one or more pad conditioners 318. Although illustrated with three polishing stations, apparatus 300 may include any desired number of polishing stations and one or more of such polishing stations may be used to buff a surface of a wafer as described herein. Furthermore, apparatus 300 may include an integrated wafer clean and dry system similar to system 104 described above.

Wafer transfer station 308 is generally configured to stage wafers before or between polishing processes and to load and unload wafers from wafer carriers described below. In addition, station 308 may be configured to perform additional functions such as washing the wafers and/or maintaining the wafers in a wet environment.

Carousel apparatus 400 includes polishing heads 402, 404, 406, and 408, each configured to hold a single wafer. In accordance with one embodiment of the invention, three of carriers 402–408 are configured to retain and urge the wafer against a polishing surface (e.g., a polishing surface associated with one of stations 302–306) and one of carriers 402–408 is configured to transfer a wafer between a polishing station and stage 308. Each carrier 402–408 is suitably spaced from post 310, such that each carrier aligns with a polishing station or station 308. In accordance with one embodiment of the invention, each carrier 402–408 is attached to a rotatable drive mechanism using a gimbal system (not illustrated), which allows carriers 402–408 to cause a wafer to rotate (e.g., during a polishing process). In addition, the carriers may be attached to a carrier motor assembly that is configured to cause the carriers to translate—e.g., along tracks 410. In accordance with one aspect of this embodiment, each carrier 402–408 rotates and translates independently of the other carriers.

In operation, wafers are processed using apparatus 300 and 400 by loading a wafer onto station 308, from station 312, using robot 314. When a desired number of wafers are loaded onto the carriers, at least one of the wafers is placed in contact with a polishing surface. The wafer may be positioned by lowering a carrier to place the wafer surface in contact with the polishing surface or a portion of the carrier (e.g., a wafer holding surface) may be lowered, to position the wafer in contact with the polishing surface. After polishing is complete, one or more conditioners—e.g., conditioner 318—may be employed to condition the polishing surfaces.

Figure 5:
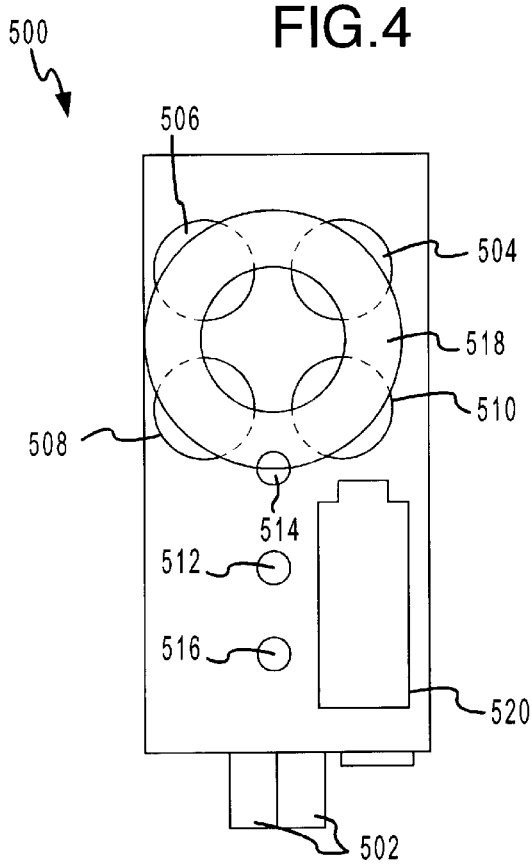
FIG. 5 illustrates a top cut-away view of a polishing system in accordance with yet another embodiment of the invention.

FIG. 5 illustrates another polishing system 500 in accordance with the present invention. System 500 is suitably configured to receive a wafer from a cassette 502 and return the wafer to the same or to a predetermined different location within a cassette in a clean, dry state.

System 500 includes polishing stations 504 and 506, a buff station 508, a head loading station 510, a transfer station 512, a wet robot 514, a dry robot 516, a rotatable index table 518, and a clean station 520.

Figure 6:
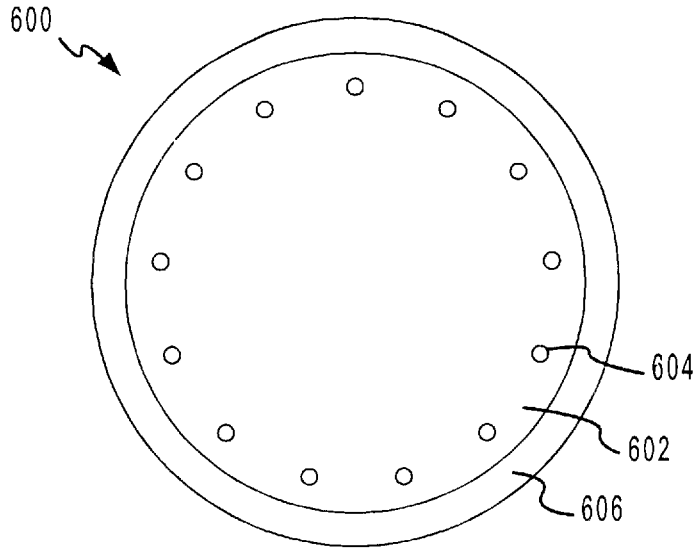
FIG. 6 illustrates a bottom view of a carrier for use with the system of FIG. 5.

During a polishing process, a wafer is held in place by a carrier 600, illustrate in FIG. 6. Carrier 600 includes a receiving plate 602, including one or more apertures 604, and a retaining ring 606. Apertures 604 are designed to assist retention of a wafer by carrier 600 by, for example, allowing a vacuum pressure to be applied to a back side of the wafer or by creating enough surface tension to retain the wafer. Retaining ring limits the movement of the wafer during the polishing process.

In operation, dry robot 516 unloads a wafer from a cassette 502 and places the wafer on transfer station 512. Wet robot 514 retrieves the wafer from station 512 and places the wafer on loading station 510. The wafer then travels to polishing stations 504–508 for polishing and returns to station 510 for unloading by robot 514 to station 512. The wafer is then transferred to clean system 520 to clean, rinse, and dry the wafer before the wafer is returned to load and unload station 502 using dry robot 516.

Figure 7:
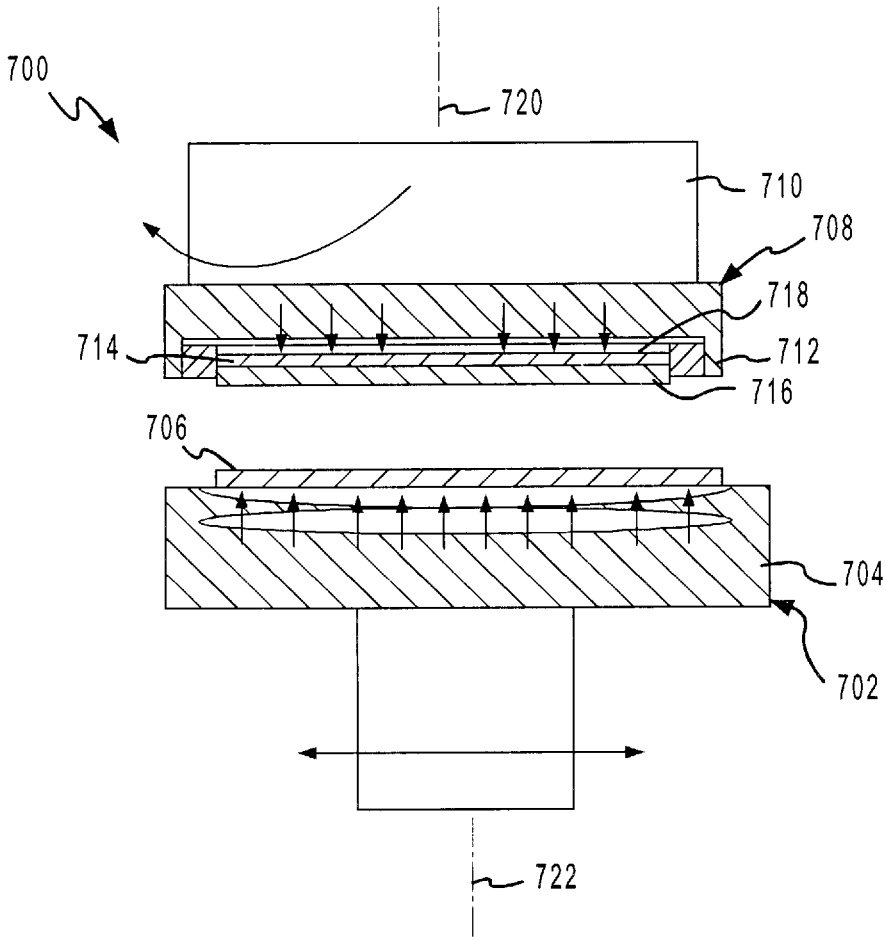
FIG. 7 illustrates a cross-sectional view of a polishing apparatus in accordance with one embodiment of the invention.
Figure 12:
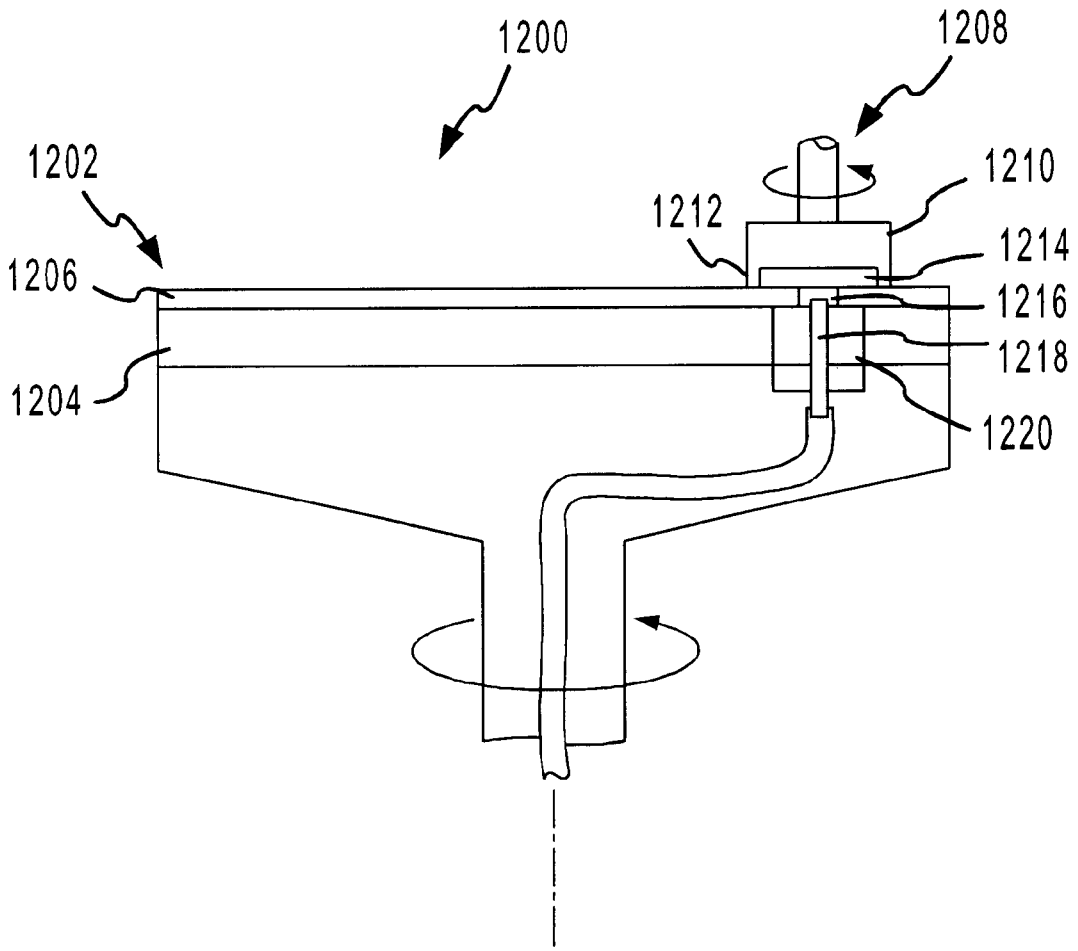
FIG. 12 illustrates a top cut-away view of a polishing apparatus in accordance with another embodiment of the invention.
Figure 13:
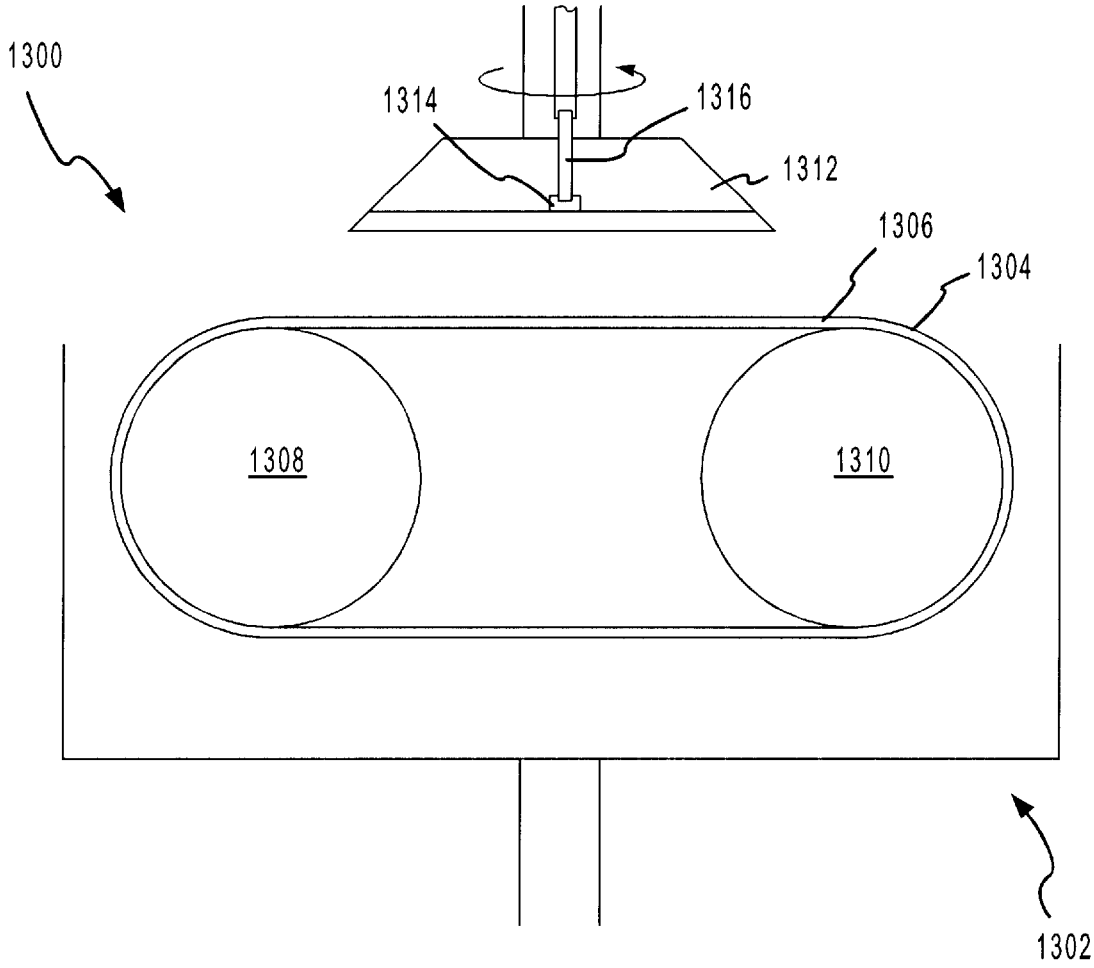
FIG. 13 illustrates a cross-sectional view of a polishing apparatus in accordance with yet another embodiment of the invention.

FIGS. 7, 12, and 13 illustrate apparatus suitable for polishing stations (e.g., polishing stations 108–114, 302–306, and 504–508) in accordance with the present invention. In accordance with various embodiments of the invention, systems such as apparatus 100, 300, and 500 may include one or more of the polishing apparatus described below, and if the system includes more than one polishing station, the system may include any combination of polishing apparatus, including at least one polishing apparatus described herein.

FIG. 7 illustrates a cross-sectional view of a polishing apparatus 700 suitable for polishing a surface of a wafer in accordance with an exemplary embodiment of the invention. Apparatus 700 includes a lower polish module 702, including a platen 704 and a polishing surface 706 and an upper polish module 708, including a body 710 and a retaining ring 712, which retains the wafer during polishing.

Upper polish module or carrier 708 is generally configured to receive a wafer for polishing and urge the wafer against the polishing surface during a polishing process. In accordance with one embodiment of the invention, carrier 708 is configured to receive a wafer, apply a vacuum force (e.g., about 55 to about 70 cm Hg at sea level) to the backside of wafer 716 to retain the wafer, move in the direction of the polishing surface to place the wafer in contact with polishing surface 706, release the vacuum, and apply a force (e.g., about 0 to about 8 psi.) in the direction of the polishing surface. In addition, carrier 708 is configured to cause the wafer to move. For example, carrier 708 may be configured to cause the wafer to move in a rotational, orbital, or translational direction. In accordance with one aspect of this embodiment, carrier 708 is configured to rotate at about 2 rpm to about 20 rpm about an axis 720.

Carrier 708 also includes a resilient film 714 interposed between a wafer 716 and body 710 to provide a cushion for wafer 716 during a polishing process. Carrier 708 may also include an air bladder 718 configured to provide a desired, controllable pressure to a backside of the wafer during a polishing process. In this case, the bladder may be divided into zones such that various amounts of pressure may be independently applied to each zone. U.S. Pat. No. 5,916,016 shows an example carrier having multiple pressure zones, which is suitable for use in connection with the present invention.

Lower polishing module 702 is generally configured to cause the polishing surface to move. By way of example, lower module 702 may be configured to cause the polishing surface to rotate, translate, orbit, or any combination thereof In accordance with one embodiment of the invention, lower module 702 is configured such that platen 704 orbits with a radius of about 0.25 to about 1 inch, about an axis 722 at about 30 to about 340 orbits per minute, while simultaneously causing the platen 704 to dither or partially rotate. In this case, material is removed primarily from the orbital motion of module 704. Causing the polishing surface to move in an orbital direction is advantageous because it allows a relatively constant speed between the wafer surface and the polishing surface to be maintained during a polishing process. Thus, material removal rates are relatively constant across the wafer surface.

Polishing apparatus including orbiting lower modules 702 are additionally advantageous because they require relatively little space compared to rotational polishing modules described below. In particular, because a relatively constant velocity between the wafer surface and the polishing surface can be maintained across the wafer surface by moving the polishing surface in an orbital motion, the polishing surface can be about the same size as the surface to be polished. For example, a diameter of the polishing surface may be about 0.5 inches greater than the diameter of the wafer.

Figure 8A:
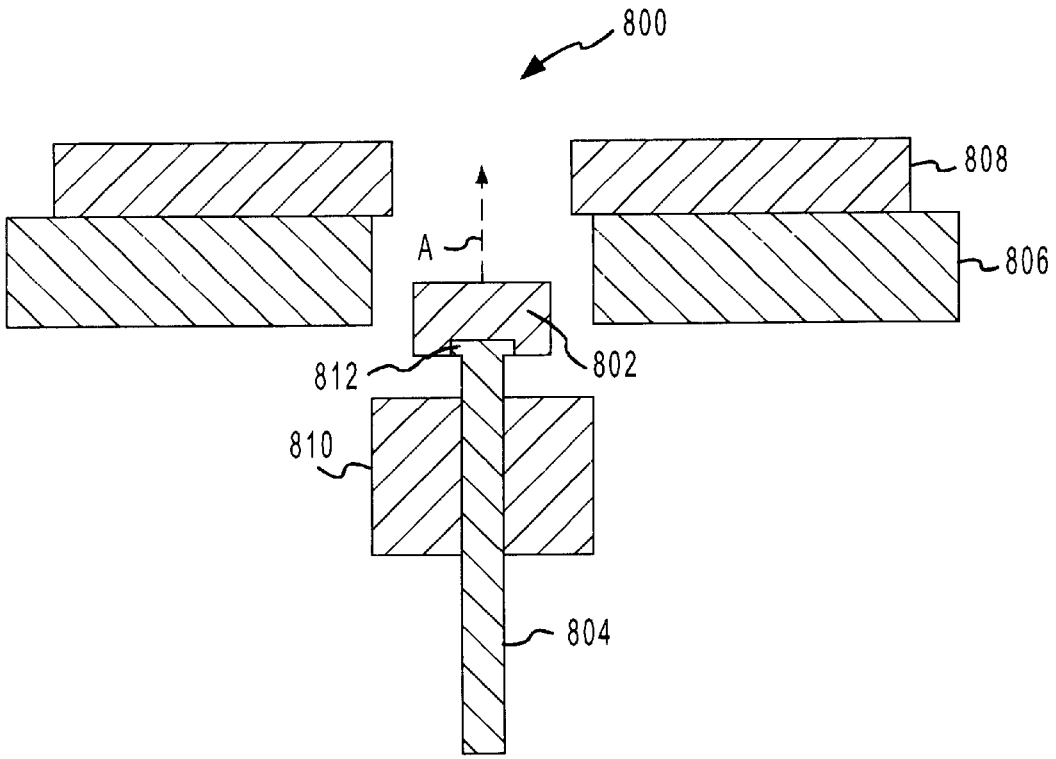
FIG. 8A illustrates a cross-sectional view of an exemplary embodiment of the endpoint detection system of the present invention shown prior to positioning the system within a polishing pad and platen.
Figure 8B:
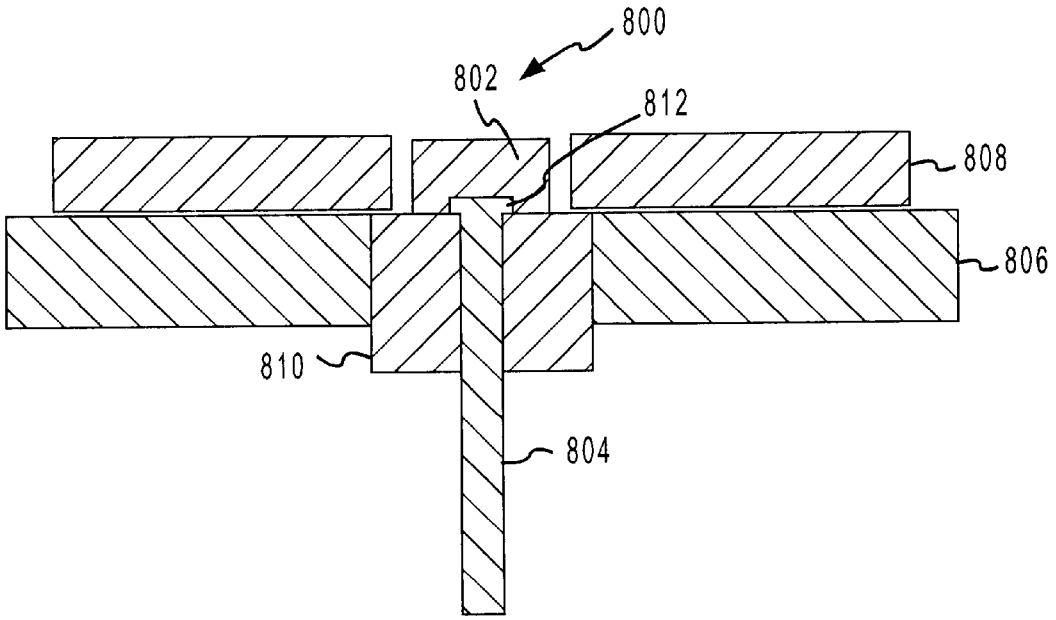
FIG. 8B illustrates a cross-sectional view of the endpoint detect system of the present invention shown subsequent to positioning the system within the polishing pad and platen for in situ monitoring of endpoint.

Turning now to FIGS. 8A and 8B, an exemplary embodiment of the endpoint detection system of the present invention. for use during CMP is shown. FIG. 8A illustrates a cross-sectional view of the exemplary endpoint detection system shown prior to positioning the system within a polishing pad and platen used during CMP while FIG. 8B illustrates a cross-sectional view of the exemplary endpoint detection system shown subsequent to positioning the system within the polishing pad and platen for in situ monitoring of endpoint.

Endpoint detection system 800 includes a transparent plug 802 secured to a probe 804 which is capable of emitting and receiving light signals which can be measured and analyzed to determine an appropriate endpoint for polishing. The combined plug and probe assembly is inserted through an opening in platen 806 and an opening in polishing pad 808 so that transparent plug 802 lies coplanar with a top surface of polishing pad 808 as shown in FIG. 8B.

In addition, endpoint detection system 800 may also include a support member 810 which is located about an outer circumference of probe 804. Support member 810 is preferably comprised of a conformable polymer material which will form a seal between polishing pad 808 and support member 810 when support member 810 is positioned within the opening in polishing pad 808. Further, support member 810 is preferably slidably engaged with an outer circumference of probe 804 such that support member 810 can be raised along an outer circumference of a vertically positioned probe 804 so that support member 810 fits snugly and securely within the opening in platen 806 thereby eliminating any leak of slurry between support member 810 and platen 806 (See FIG. 8B).

Moreover, in accordance with another aspect of the invention, a sleeve member 812 may be located within a bottom portion of transparent plug 802 for receiving probe 804. Sleeve member 812 is preferably a concentric ring or hollow tube member designed to reinforce the area of plug 802 which receives probe 804. Sleeve member 812 is preferably comprised of a rigid material such as, for example, stainless steel. Sleeve member 812 may be permanently secured within a bottom portion of plug 802 or alternatively may comprise a separate element that forms a tight fit with both plug 802 and probe 804 when all are assembled together.

Plug 802 preferably comprises a transparent polymer such as, for example, a clear polyurethane, that is chemically resistant to slurry. Plug 802 must also be capable of allowing light signals to pass therethrough.

Probe 804 is preferably comprised of an optically conducting fiber material encased in a stainless steel housing and has two open ends, one of which is positioned within transparent plug 802 and one of which is connected to at least one source for receiving and/or emitting light signals. Probe 804 may alternatively comprise two closed ends that are comprised of a material capable of allowing light signals to pass therethrough.

Support member 810 preferably comprises a conformable polymer material that is chemically resistant and has a hardness that is not much greater than the hardness of pad 808. Further, the material comprising support member 810 is preferably close in hardness and corrosion characteristics to the material comprising probe 804. Alternatively, support 810 may comprise a metal element which uses O-rings and/or other types of sealing elements to create a seal between support 810 and platen 806.

Plug 802, probe 804, and support 810 may be formed to create a single disposable and replaceable element or, alternatively, one or more of each of plug 802, probe 804, and support 810 may be designed as disposable and replaceable pieces. For example, transparent plug 802 may be the only disposable and replaceable piece in the system.

In utilizing the endpoint detection system of the present invention, probe 804 is positioned within plug 802 and support 810 is positioned about an outer circumference of probe 804. Plug 802 is then placed through the opening in platen 806 and into the opening in pad 808. The top of plug 802 is positioned such that it is coplanar with the polishing surface of pad 808. Support 810 is placed into the opening of platen 806 and, to adjust support 810, a uniform force is applied across the polishing surface of pad 808 and the top of plug 802 while support 810 is pushed into the opening in platen 806 until a tight fit is obtained.

It will be understood by those skilled in the art that the endpoint detection system illustrated in FIGS. 8A and 8B can be used in any CMP system which utilizes a polishing pad and platen, or alternatively, any single polishing surface that is capable of receiving a removable and replaceable transparent plug member. Means for transmitting and receiving light signals and analyzing the same to determine endpoint are well known in the art and are herein incorporated by reference. The endpoint detection system of the present invention is particularly useful in those CMP machines having a lower polishing module and platen, and a carrier for retaining a workpiece, where the carrier and polishing surface are brought into contact with one another in order to planarize the workpiece. The endpoint detection system of the present invention may also be used for a more limited number of polishing applications by placing the endpoint detection system in the carrier element as later shown in FIG. 13.

Figure 9:
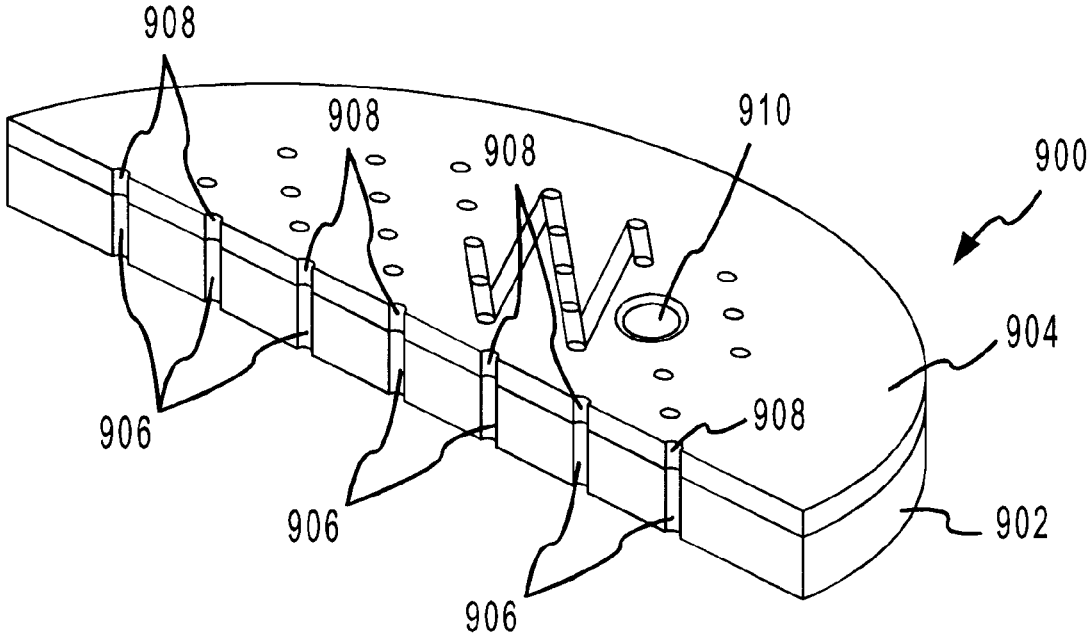
FIG. 9 illustrates a portion of the polishing apparatus of FIG. 7 in greater detail.

FIG. 9 illustrates a portion of a lower polishing module 900, including a platen 902 and a polishing surface 904, suitable for use with polishing apparatus 700 and 800. Platen 902 and polishing surface 904 include channels 906 and 908 formed therein to allow polishing fluid such as slurry to flow through platen 902 and surface 904 toward a surface of the wafer during the polishing process. Flowing slurry toward the surface of the wafer during the polishing process is advantageous because the slurry acts as a lubricant and thus reduces friction between the wafer surface and polishing surface 904. In addition, providing slurry through the platen and toward the wafer facilitates uniform distribution of the slurry across the surface of the wafer, which in turn facilitates uniform material removal from the wafer surface. The slurry flow rates may be selected for a particular application; however, in accordance with one embodiment of the invention, the slurry flow rates are less than about 200 ml/minute and preferably about 120 ml/minute. Platen 902 and polishing surface 904 may also include the endpoint detection system of the present invention as previously described with reference to FIGS. 8A and 8B and as shown by the presence of transparent plug 910 which is coplanar with polishing surface 904. Those skilled in the art will appreciate that more than one such plug and probe assembly may be used and positioned within platen 902 and polishing surface 904 in order to more accurately determine endpoint.

Figure 10A:
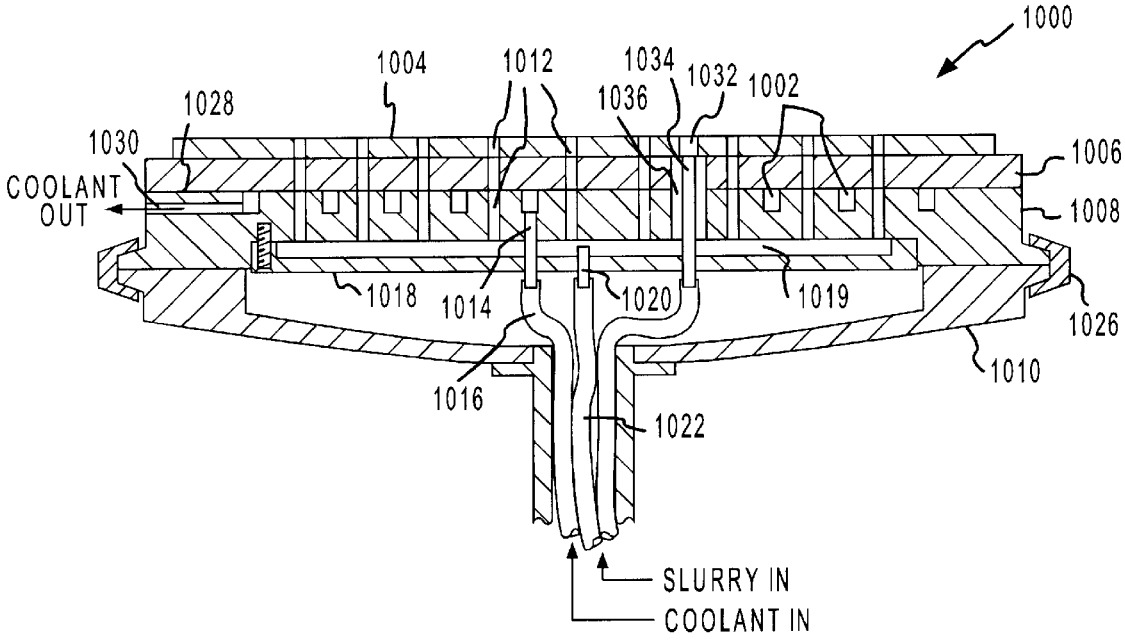
FIGS. 10A and 10B illustrate a platen including heat exchange channels in accordance with the present invention.
Figure 10B:
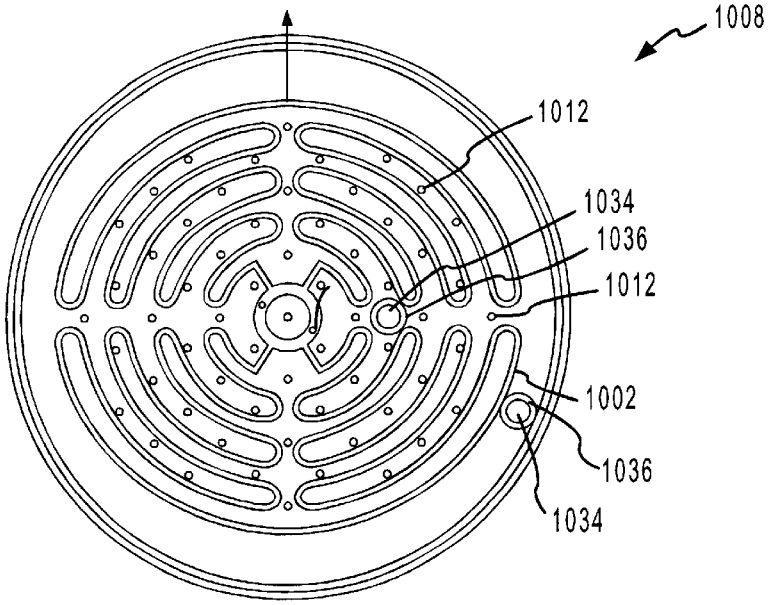

FIGS. 10A and 10B illustrate a portion of a lower polish module 1000 in accordance with yet another embodiment of the invention. Structure or polish head 1000 includes a fluid channel 1002 to allow heat exchange fluid such as ethylene glycol and/or water to flow therethrough to cool a surface of a polishing surface 1004 such as a polishing pad. Module 1000 is suitably formed of material having a high thermal conduction coefficient to facilitate control of the processing temperature.

Lower polish head 1000 includes a top plate 1006, a channel plate 1008, and a base plate or bell housing 1010, which are coupled together to form polish head 1000. Top plate 1006 includes a substantially planar top surface to which a polishing surface 1004 such as a polishing pad is attached—e.g., using a suitable adhesive. Channel section 1008 includes channel 1002 to allow heat exchange fluid to flow through a portion of polish head 1000. Bottom section 1010 is configured for attachment of the polish head to a platen shaft. To allow slurry circulation through polish head 1000, cover plate 1006, channel section 1008, and bottom plate 1010 each include channels 1012 similar to channels 906 and 908, illustrated in FIG. 9, through which a polishing solution may flow. In accordance with one exemplary embodiment of the invention, top plate 1006 is brazed to channel section 1008 and the combination of top plate 1006 and channel plate. 1008 is coupled to lower plate 1010 using clamp ring 1026, or alternatively another suitable attachment mechanism such as bolts.

Further, as previously described with reference to FIGS. 8A and 8B, lower polish head 1000 may include a transparent plug 1032 attached to a probe 1034 where transparent plug 1032 is positioned through openings in polishing pad 1028 and plates 1006 and 1008 such that plug 1032 lies coplanar with the polishing surface of pad 1028, and probe 1034 is positioned within in openings in plates 1006 and 1008 such that a seal is formed between plates 1006 and 1008 and a support 1036 which is positioned about a circumference of probe 1034. However, support 1036 may not be required if probe 1034 is positioned within polish head 1000 such that no slurry leaks are created.

Heat exchange fluid is delivered to polish head 1000 through a fluid delivery conduit 1014 and a flexible fluid delivery tube 1016. Fluid circulates through channel 1002 and exits at outlet 1030.

Slurry is distributed to polish head 1000 using a flexible slurry delivery tube 1022 and a slurry delivery conduit 1020 to deliver the slurry to a slurry chamber 1019. Slurry is then distributed to a top surface of polish head 1000 using conduits 1012. In accordance with one aspect of this embodiment, slurry chamber 1019 is formed by securing a slurry manifold cover 1018 to a lower surface of channel section 1008.

In an alternative embodiment, the channel groove is formed in the underside of the cover plate. The channel groove may be sealed by attaching a circular disk having a planar top surface to the underside of the cover plate. The bottom section is attached to the circular disk, or, alternatively, the junction of the circular disk and the bottom section could be combined. In either this case or the illustrated case, a channel groove through which a heat exchange fluid can be circulated is formed beneath the substantially planar surface of the platen assembly.

In accordance with yet another embodiment of the invention, the temperature of the polishing process may be controlled by providing a heat exchange fluid to the backside of a wafer. Apparatus for exposing a heat exchange fluid to the backside of a wafer are well known in the art. For an example of an apparatus configured to regulate the polishing rate of a wafer by backside heat exchange, see U.S. Pat. No. 5,605,488, issued to Ohashi et al. on Feb. 25, 1997, which patent is hereby incorporated by reference.

Figure 11:
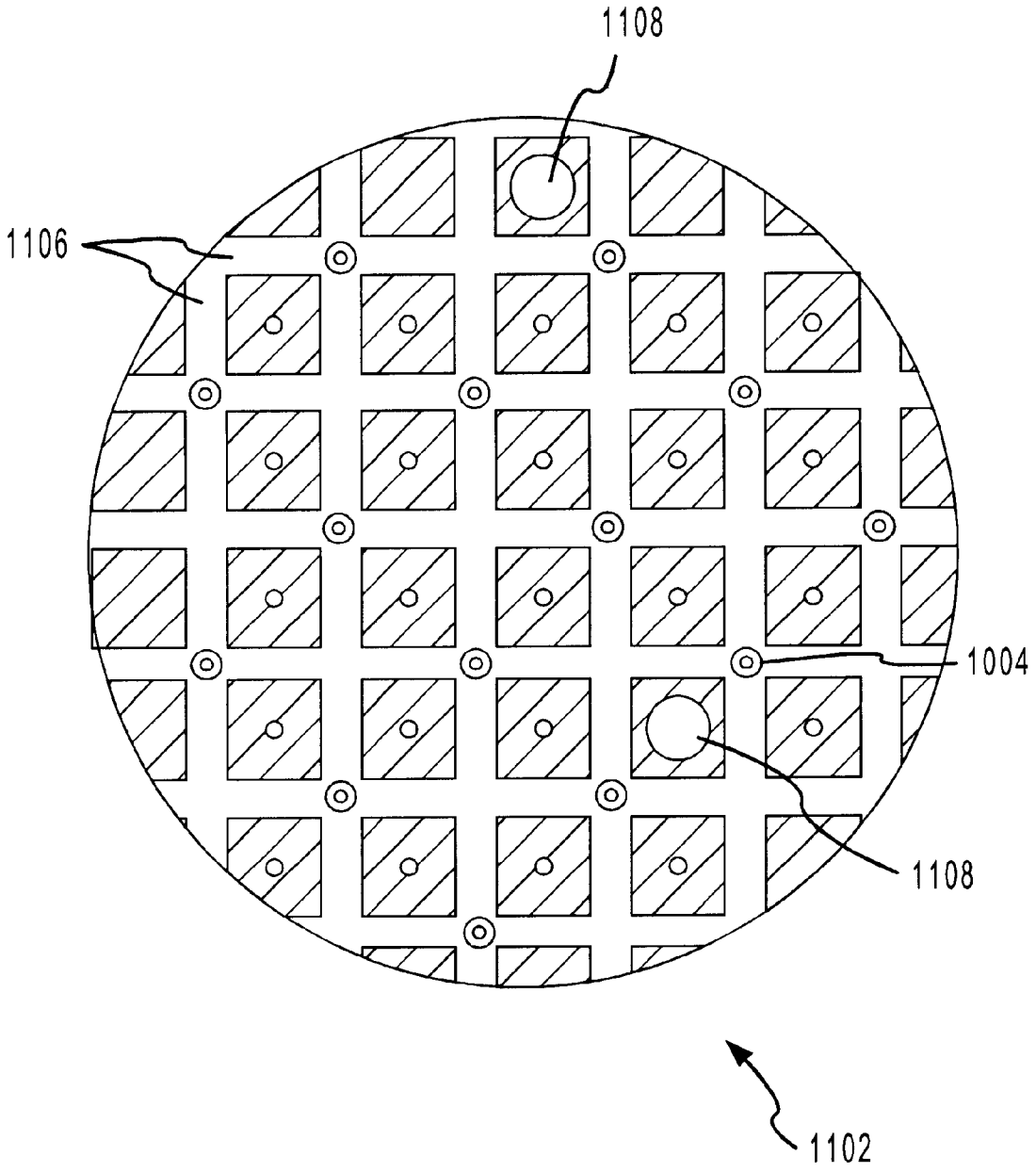
FIG. 11 illustrates a top plan view of a polishing surface, having grooves and apertures, in accordance with the present invention.

FIG. 11 illustrates a top view of polishing surface 1102 in accordance with the present invention. Polishing surface 1102 includes apertures 1104 extending through surface 1102. Apertures 1104 are suitably aligned with channels formed within a platen (e.g., platen 902), such that polishing solution may circulate through the platen and polishing surface 1102 as described above in connection with FIGS. 9, 10A, and 10B. Surface 1102 also includes grooves 1106. Grooves 1106 are configured to effect transportation of the polishing solution on polishing surface 1102 during a polishing process. Polishing surface 1102 may also be porous, further facilitating transportation of the polishing solution. It will be appreciated that polishing surface 1102 may have any suitably-shaped openings that are configured to produce a uniform or other desired slurry distribution across the surface. For example, grooves 1106 may be configured to facilitate a hydroplaning action such that a wafer floats on polishing solution during a polishing process. In accordance with one exemplary embodiment of the invention, surface 1102 is formed of polyurethane, having a thickness of about 0.050 to about 0.080 inches, and grooves 1106 are formed using a gang saw, such that the grooves are about 0.015 to about 0.045 inches deep, with a pitch of about 0.2 inches and a width of about 0.15 to about 0.30 inches. Moreover, the endpoint detection system of the present invention as previously described with reference to FIGS. 8A and 8B may also be incorporated with this polishing system as evidenced by transparent plugs 1108.

FIG. 12 illustrates a cross-sectional view of a polishing apparatus 1200 suitable for polishing a surface of a wafer in accordance with another exemplary embodiment of the invention. Apparatus 1200 includes a lower polish module 1202, including a platen 1204 and a polishing surface 1206 and an upper polish module 1208, including a body 1210 and a retaining ring 1212, which retains the wafer during polishing. Apparatus 1200 may also include a slurry distribution apparatus to supply a polishing fluid to a top surface of lower module 1202.

Upper module 1208 is configured to cause the wafer to rotate, orbit, translate, or a combination thereof and to retain the wafer. In addition, upper module 1208 is configured to apply a pressure to wafer 1214 in the direction of lower module 1202, as discussed above in reference to upper module 708. Lower module is generally configured to move a polishing surface by rotating platen 1204 about its axis. Polishing apparatus may also include plug 1216, probe 1218, and support 1220 which comprise a part of the endpoint detection system previously described with reference to FIGS. 8A and 8B.

Although apparatus 1200 may be used to polish wafers in accordance with the present invention, apparatus 1200 generally requires additional space compared to apparatus 700. In particular, the diameter of polishing surface 1206 is generally about twice the diameter of wafer 1214, whereas polishing surface 706 of lower module 702 is about the same size as the wafer. Additionally, because lower platen 1200 rotates about an axis, delivery of a polishing solution through platen 1204 may be problematic. Thus, several of the advantages associated with through-platen slurry delivery may be difficult to achieve using a rotational platen system, as illustrated in FIG. 12.

In operation, a wafer 1214 surface is polished by moving wafer 1214 using upper module 1208, while simultaneously rotating lower polishing module 1202 and polishing surface 1206 attached thereto. In accordance with one exemplary embodiment of the invention, upper module moves wafer 1214 in both a rotational and a translational direction during the polishing process. In accordance with another embodiment, upper module 1208 orbits about an axis.

FIG. 13 illustrates a linear polishing apparatus 1300, suitable for use in a polishing station, in accordance with another embodiment of the invention. Apparatus 1300 includes a lower polishing module 1302, including a polishing surface 1304 attached to a belt 1306, and rollers 1308 and 1310 and an upper module 1312, which may be the same as upper module 708 or 1208 with the exception that the endpoint detection system previously described with reference to FIGS. 8A and 8B may be included in the upper module 1312 instead of the lower polishing module as shown by the presence of transparent plug 1314 and probe 1316. However, in that transparent plug 1314 will be lying adjacent a back surface of a wafer, this configuration has limited applications for determining endpoint since the wafer, at some point, will be too thick to determine endpoint by way of measuring light signals being reflected from its back surface.

To effect polishing, carrier 1312 and/or polishing surface 1304 move relative to each other. For example, polishing may be effected primarily by moving surface 1304 relative to the wafer surface while rotating the wafer about the carrier axis. A linear polishing apparatus suitable for use in connection with the present invention is described in European Patent Application No. EP 0 916 452 A2, published on May 19, 1999, the content of which is hereby incorporated by reference.

Although the present invention is set forth herein in the context of the appended drawing figures, it should be appreciated that the invention is not limited to the specific form shown. For example, the plug and probe assembly may function alone without the aid of a support member. In addition, other types of configurations and shapes for the plug and support member may be used to carry out the endpoint detection method of the present invention and each of the components, namely the plug, probe and support member, may be individually replaceable. Various other modifications, variations, and enhancements in the design and arrangement of the chemical mechanical polishing methods and apparatus as set forth herein may be made without departing from the spirit and scope of the present invention as set forth in the appended claims.

What is claimed is:

1. An apparatus for endpoint detection during chemical mechanical polishing comprising:

a probe member having an end for emitting and receiving light;

a transparent plug mounted over the end of said probe member wherein said plug is inserted through an opening in a polishing pad for transmitting and receiving light therethrough during polishing; and a support member located beneath said plug and about a circumference of said probe member wherein said support member is positioned within, and forms a seal with, an opening in a platen.

2. The apparatus of claim 1 wherein the plug is removable.

3. The apparatus of claim 1 wherein said support member is slidably engaged along a length of said probe.

4. The apparatus of claim 1 wherein said support member comprises a conformable polymer material.

5. The apparatus of claim 1 wherein said plug is positioned within an opening in a polishing pad such that a top of the plug is coplanar with a polishing surface of the polishing pad.

6. An apparatus for endpoint detection during chemical mechanical polishing comprising:

a probe member having an end for emitting and receiving light, and a transparent plug comprising a polymer that is chemically resistant to slurry mounted over the end of said probe member wherein said plug is inserted through an opening in a polishing pad for transmitting and receiving light therethrough during polishing.

7. The apparatus of claim 6 wherein said polymer comprises a clear polyurethane.

8. The apparatus of claim 1 further comprising a sleeve member located within said plug for receiving said probe member.

9. The apparatus of claim 8 wherein said sleeve member comprises stainless steel.

10. An apparatus for endpoint detection during chemical mechanical polishing comprising:

a probe member having an end for emitting and receiving light;

a transparent plug mounted over the end of said probe member wherein said plug is inserted through an opening in a polishing pad for transmitting and receiving light therethrough during polishing;

a support member located beneath said plug and about a circumference of said probe member wherein said support member is positioned within an opening in a platen; and a sealing mechanism for creating a seal between said support member and said platen.

11. The apparatus of claim 10 wherein said sealing mechanism comprises at least one of an O-ring or an adhesive.

12. A method for detecting endpoint detection during CMP comprising the steps of:

selecting a probe member having an end for emitting and receiving light;

mounting a transparent plug over the end of said probe;

inserting said plug through an opening in a polishing pad;

polishing a workpiece using said polishing pad; and transmitting and receiving an optical signal through said probe to determine an endpoint for polishing.

13. The method of claim 12 further comprising the steps of positioning a support member about an outer circumference of said probe below said plug; and inserting said support member into an opening in a platen used to retain said polishing pad.

14. The method of claim 13 wherein said step of inserting said support comprises the step of slidably engaging said support relative to said probe such that said support fits within said opening of the platen.

15. The method of claim 12 wherein said step of inserting said plug comprises the step of moving said probe member.

* * * * *